US006553694B2

(12) United States Patent
Martinez

(10) Patent No.: US 6,553,694 B2
(45) Date of Patent: Apr. 29, 2003

(54) WINCH ATTACHMENT FOR BACKHOE MACHINES

(76) Inventor: Frank S. Martinez, P.O. Box 2374, Julian, CA (US) 92036

( * ) Notice: Subject to any disclaimer, the term of this patent is extended or adjusted under 35 U.S.C. 154(b) by 0 days.

(21) Appl. No.: 09/909,089

(22) Filed: Jul. 19, 2001

(65) Prior Publication Data

US 2003/0014887 A1 Jan. 23, 2003

(51) Int. Cl.[7] ..... E02F 3/76
(52) U.S. Cl. ..... 37/403; 405/154
(58) Field of Search ..... 37/397, 403, 404; 212/175, 232; 254/323, 326, 327, 328, 380; 405/154, 156, 184

(56) References Cited

U.S. PATENT DOCUMENTS

| | | | | |
|---|---|---|---|---|
| 2,997,276 A | | 8/1961 | Davis | |
| 3,527,362 A | | 9/1970 | Allen | |
| 3,900,185 A | | 8/1975 | Burr | |
| 4,093,034 A | | 6/1978 | Curley et al. | |
| 4,102,528 A | | 7/1978 | Cripe | |
| 4,523,684 A | * | 6/1985 | Baisden | 212/175 |
| 4,650,163 A | | 3/1987 | Peterson | |
| 4,950,125 A | | 8/1990 | Gravenhorst | |
| 5,048,172 A | | 9/1991 | Gravenhorst | |
| 5,238,225 A | | 8/1993 | Hunt | |
| 5,711,636 A | * | 1/1998 | Boyer | 138/97 |
| 6,152,425 A | * | 11/2000 | Boyer | 212/232 |

* cited by examiner

*Primary Examiner*—Robert E. Pezzuto
(74) *Attorney, Agent, or Firm*—Shook, Hardy & Bacon L.L.P.

(57) ABSTRACT

A winch attachment for a backhoe replaces a bucket normally carried on the backhoe boom to allow the backhoe to engage in winching operations. The winch attachment includes a winch bracket which is detachably secured to the mounting bracket on the end of the boom where the bucket is normally mounted. The winch bracket includes a pivotally mounted frame carrying the winch drum and cable so that the winch can be pivoted to the side when necessary. Quick connect hydraulic couplings are applied to the hydraulic winch motor to allow the backhoe hydraulic system to control the operation of the winch.

12 Claims, 2 Drawing Sheets

WINCH ATTACHMENT FOR BACKHOE MACHINES

FIELD OF THE INVENTION

The present invention relates generally to construction equipment and more particularly to a winch attachment that can be mounted on the boom of a backhoe in order to facilitate various jobs such as pulling pipes beneath roadways.

BACKGROUND OF THE INVENTION

Backhoe machines have long been used in a variety of earth moving operations such as excavating and trenching. Backhoes are widely used in the laying of pipelines because they are well suited to forming trenches and then filling the trenches after the pipes have been placed in them. In many pipeline projects, there is a need to route the pipes under roadways and other crossings, and these types of operations complicate the pipeline laying process.

Although backhoes can easily form trenches and other excavations, they are not well suited for placing pipes beneath roadways, and they are not able to pull pipes through other pipes in a procedure that is commonly referred to as "pipe bursting". Consequently, when the need arises for these types of operations, it is necessary to bring in special equipment or to set up a system of lines and pulleys. Both of these options are undesirable because of the costs that are involved and the delays that are often encountered.

SUMMARY OF THE INVENTION

Accordingly, there is a need for equipment that can be used in conjunction with a backhoe to pull pipes under roadways and other excavations as well as through other pipes. The primary goal of the present invention is to provide such equipment so that the costs of specialized machinery or complicated pulley systems can be avoided.

In accordance with the invention, a winch is provided with a special frame that allows it to be applied to a backhoe. The bucket that is normally carried on the end of the boom of the backhoe can be detached and disconnected from the hydraulic lines that control its operation. In place of the bucket, the winch is mounted on the backhoe boom and is connected to the hydraulic lines so that the hydraulic system of the backhoe can be used for operation of the winch. Alternatively, the winch can be mounted to the bucket and connected with auxiliary hydraulics that are typically present on the backhoe machine.

In either case, the winch is mounted on the backhoe at the end portion of the boom where it can be positioned properly for jobs such as pulling pipes through tunnels and trenches as necessitated by the presence of roadways or other pipeline crossings or obstacles. The winch can also be used in pipe bursting to pull pipes through other pipes. It is a particular feature of the invention that the existing backhoe hydraulics are used to advantage for operation of the winch, thus avoiding the need to equip the winch with a separate power system.

It is preferable for the winch to be able to pivot through a significant arc that may be as great as a full revolution. The advantage of this construction is that the winch line can be angled as necessary relative to the boom so that it can pull from the side or in other directions in a situation where space is limited or there are obstacles in the work area. The pivotal mounting of the winch is preferably accomplished by providing a special winch bracket. The bracket may include sturdy plates that are mounted to the backhoe mounting bracket and have rigid arms extending from them. A winch frame which carries the winch may be pivotally mounted on the ends of the arms. By virtue of this arrangement, the winch can pivot in a manner allowing the winch cable to be extended to the side or at virtually any other desired angle. At the same time, the mounting system has a sturdy construction which exhibits the strength necessary to withstand the considerable forces that may be encountered when the winch is in operation. Alternatively, the winch can be mounted with the winch axis in a vertical orientation so that the winch cable can be angled to the side as necessary.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
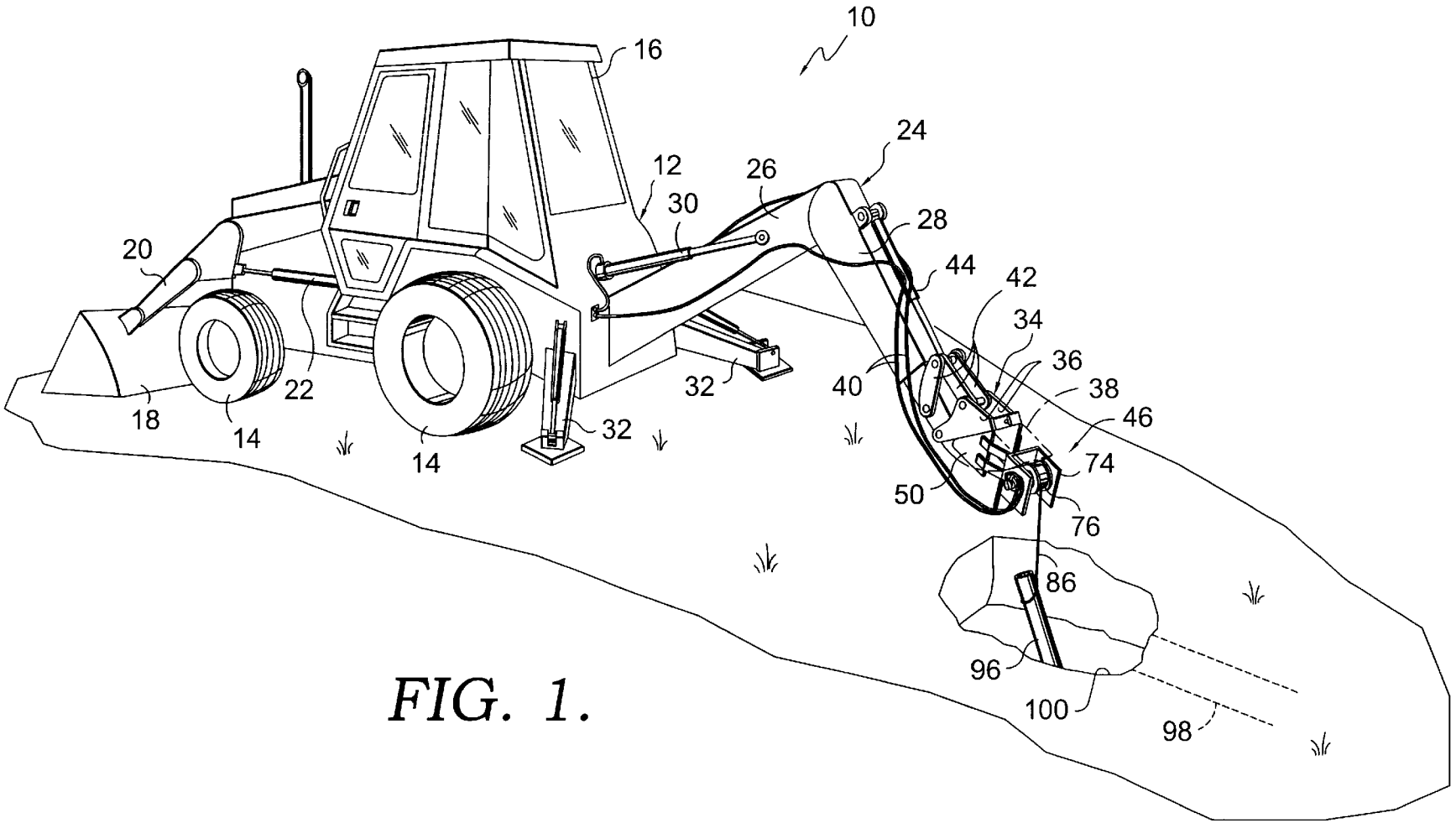
FIG. 1 is a perspective view showing a winch attachment mounted on the end of the boom of a backhoe in accordance with a preferred embodiment of the present invention, with the winch being used for the handling of a pipe section.

Referring now to the drawings in more detail and initially to FIG. 1, numeral 10 generally designates a conventional backhoe which includes a tractor 12 having wheels 14 and an operator's cab 16. The backhoe 10 is equipped on the front side of the cab with a scoop or shovel 18 that is carried on the ends of arms 20 and controlled by hydraulic cylinders 22. The tractor 12 is driven by a conventional engine (not shown) and is equipped with a hydraulic system of the type normally provided on backhoes.

The rear end of the cab 12 is provided with a boom which is generally identified by numeral 24 and which includes a front section 26 and a back section 28 connected to pivot relative to the front section 26. Hydraulic cylinders 30 are provided to control the boom 24. The backhoe 10 has suitable outriggers 32 which provide stability when the boom 24 is being used.

The back end of the rear boom section 28 carries a mounting bracket 34 having a pair of rigid side plates 36 which are spaced apart and parallel. A bucket 38 (shown in broken lines in FIG. 1) is normally mounted on the mounting bracket 34 and is controlled in its operation by hydraulic fluid lines 40 which are controlled by the hydraulic system of the backhoe 10. The rear boom section 28 is equipped with a plurality of control links 42 and a hydraulic cylinder 44 which operates the links 42 for manipulation of the bucket 38 when it is in place. The fluid lines 40 are provided on their ends with quick disconnect couplings 45 (see FIG. 2) which allow them to be quickly connected to and disconnected from the bucket 38.

In accordance with the present invention, the bucket 38 is detached from the mounting bracket 34 and is replaced by a winch attachment which is generally identified by numeral 46.

Figure 2:
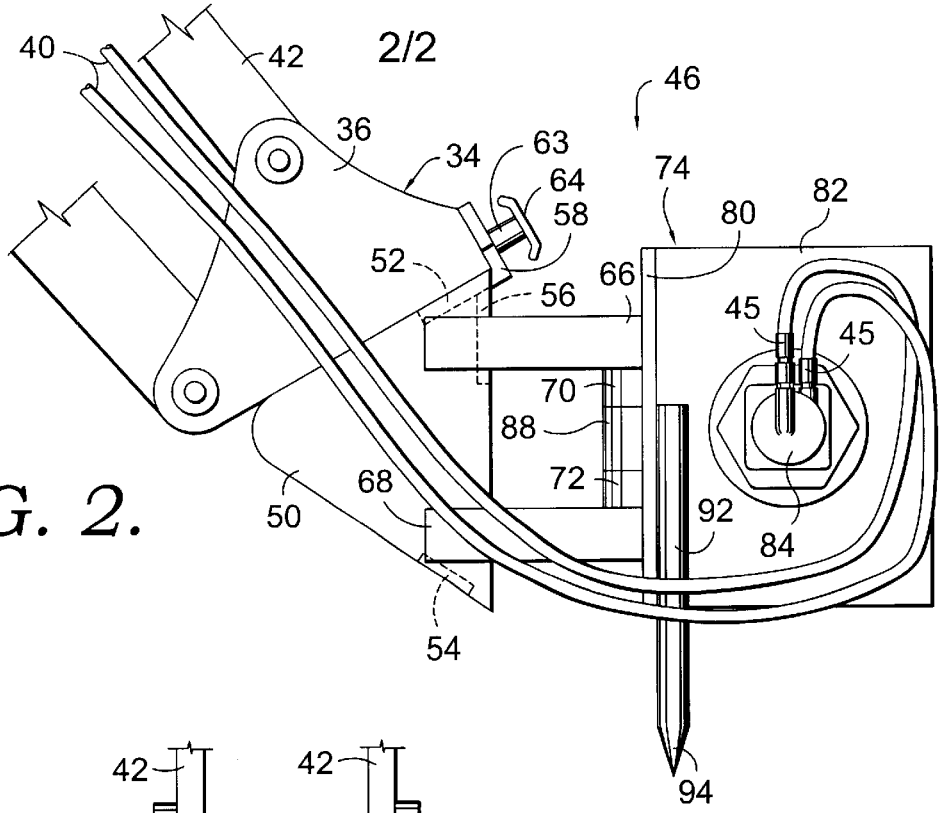
FIG. 2 is a fragmentary side elevational view on an enlarged scale of the end portion of the backhoe boom showing the winch attachment mounted on the boom.
Figure 3:
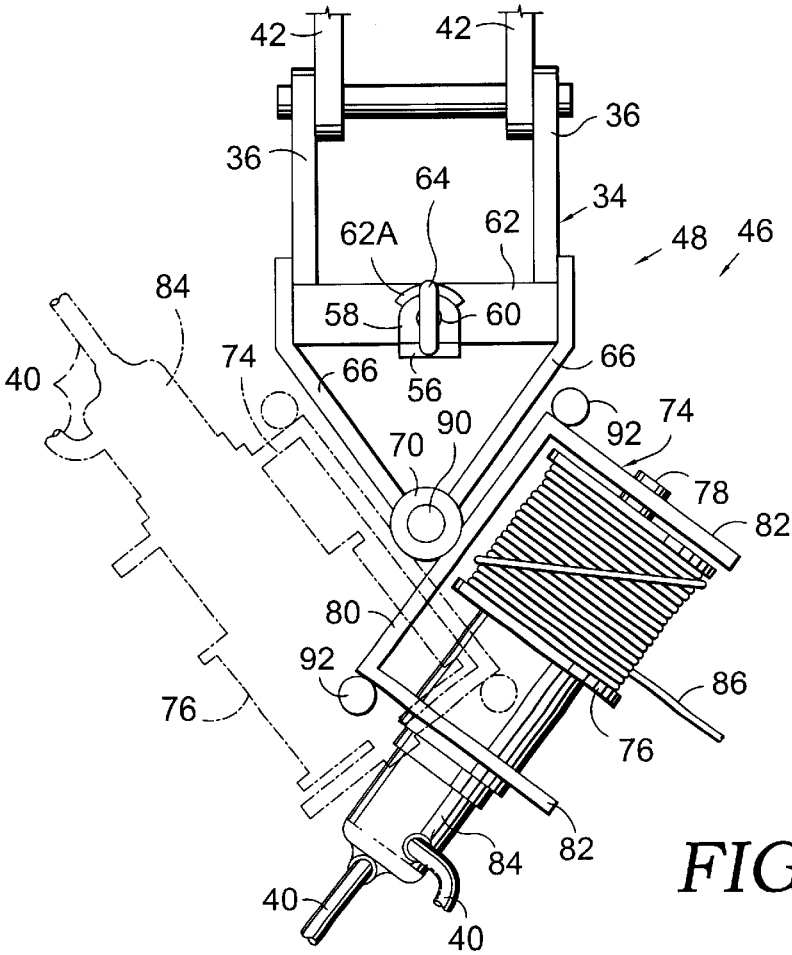
FIG. 3 is a fragmentary top plan view of the end of the boom and the winch attachment, with the broken lines indicating pivoting of the boom from the position shown in solid lines in accordance with a preferred embodiment of the invention.

With additional reference to FIGS. 2 and 3, the winch attachment 46 includes a winch bracket which is generally identified by numeral 48 and which is mounted to the mounting bracket 34 on the end of the backhoe boom 24. The winch bracket 48 includes a pair of rigid side plates 50 which are mounted adjacent to the side plates 36 of the mounting bracket 34 when the winch attachment 46 is in place on the backhoe. The side plates 50 are spaced apart and parallel to one another and fit against the plates 36 generally edge to edge, as best shown in FIG. 2. A rigid crossbar 52 extends between plates 50 and their upper edges. Another crossbar 54 extends between the lower edges of the plates 50 to provide the mounting plate structure with a strong and rigid construction. An additional crossbar 56 extends between the rear edges of the plates 50 and is provided on its upper end with a projecting tongue 58 having an opening 60 (FIG. 3).

With reference to FIG. 3 in particular, bracket 34 is provided with a crossbar 62 which extends between the upper edges of the bracket plates 36. The crossbar 62 is provided with an opening that registers with the opening 60 when the winch bracket 48 is applied to the backhoe mounting bracket 34. A curved collar 62*a* is provided on bar 62 and mates with the edge of tongue 58 to provide guidance for alignment of the openings in tongue 58 and bar 62. A detachable pin 63 may be applied through the aligned openings in tongue 58 and crossbar 62 to secure the winch bracket 48 to the backhoe mounting bracket 34. The pin 63 may be provided with a tee handle 64 to facilitate its application and removal. The pin 63 rigidly locks brackets 48 and 34 together. Pin 63 is also used for the mounting of the bucket 38 on bracket 34 in a similar manner. The pin 63 may be withdrawn in order to release bucket 38 and allow it to be detached so that the winch attachment 46 can be installed on bracket 36.

A pair of rigid upper arms 66 and a pair of rigid lower arms 68 are welded or otherwise rigidly secured to extend generally rearwardly from the side plates 50. As best shown in FIG. 3, the arms 66 and 68 converge as they extend rearwardly. The back ends of the upper arms 66 are rigidly connected with an upper hinge barrel 70, and the lower arms 68 similarly carry on their back ends a lower hinge barrel 72 (FIG. 2) which is spaced below and aligned with the upper hinge barrel 70.

The winch bracket 48 further includes a C-shaped winch frame 74 to which a winch drum 76 is mounted. The drum 76 is mounted for rotation on the frame 74 about a winch axis defined by an axle 78 about which the winch drum 76 turns. The frame 74 includes a back plate 80 and a pair of side plates 82 connected with the back plate. The winch drum 76 is mounted between the side plates 82 and is driven by a conventional hydraulic motor 84 mounted to one of the side plates 82. The motor 84 is connected with the hydraulic lines 40 by means of the quick disconnect couplings 44. The application of fluid to the motor 84 is controlled by the existing hydraulic system of the backhoe 10, and the motor may be operated to rotate the winch drum 76 in opposite directions about the axle 78. A winch cable 86 is wound around the winch drum 76 and is wound in and out on the drum as the drum is rotated in opposite directions by the motor 84.

The winch frame 74 and drum 76 are mounted on the back ends of the arms 66 and 68 for pivotal movement. As best shown in FIG. 2, the back plate 80 of the frame 74 is provided with a hinge barrel 88 which fits closely between the hinge barrels 70 and 72. A hinge pin 90 (FIG. 3) is applied through the hinge barrels 70, 72 and 88 such that the barrel 88 can turn about the pivot axis provided by the pin 90. In this fashion, the winch drum 76 and frame 74 can be pivoted about the pivot axis of pin 90 between the positions shown in solid lines and broken lines in FIG. 3. It should be understood, however, that the winch drum may be mounted in a manner allowing it to pivot through virtually any desired arc, including a full 360° rotation. The pivot axis provided by pin 90 is perpendicular to the winch axis provided by axle 78.

The winch frame 74 may be provided with a pair of stakes 92. The stakes 92 have pointed lower ends 94 allowing them to be impaled into the ground in order to stabilize the winch during operation. The stakes 92 may be welded or otherwise suitably secured to suitable portions of frame 74 such as the side plates 82.

The winch attachment 46 may be installed on the backhoe 10 in the manner indicated in place of the bucket 38 when there is a need for use of the winch in various types of operations. For example, if an object such as the pipe 96 shown in FIG. 1 needs to be pulled through an excavation such as a tunnel 98, the bucket 38 can be detached from the backhoe and the winch attachment 46 can be installed. The end of the winch cable 86 can be suitably attached to the pipe 96, and the backhoe boom 24 can be manipulated to move the winch into position to manipulate the pipe 96 as desired.

Typically, the winch attachment 46 can be used to pull pipes through tunnels 98 that extend under roadways or other crossings, or through other pipes. In this type of application, the boom 24 of the backhoe is manipulated to locate the winch in line with the tunnel 98 through which the pipe is to be pulled. The cable 86 can be unwound by rotating the winch drum 76 in the proper direction, and the end of the cable can then be secured to one end of the pipe. The motor 84 can then be operated in a mode to wind up the cable 86 on the winch drum 76, thereby pulling the pipe through the tunnel 98. Usually, in this type of application, the pipe is used as a conduit that is left in place in extension through the tunnel 98 underneath the roadway or other crossing for purposes such as drainage or to allow cables or other underground devices to be placed beneath the roadway at a subterranean location.

In many applications, obstacles in the area of the job site may prevent the boom 24 from being aligned with the tunnel 98 or other excavation that is the subject of the work. In the event that this type of situation arises, the boom can be placed at an angle to the tunnel 98, and the winch frame 74 can be pivoted to one side or the other about the pivot axis of the pin 90, thus allowing the cable 86 to be positioned in line with the tunnel 98 to facilitate pulling of the pipe 96 or other structure through the tunnel. The pivotal mounting of the winch thus enhances the versatility of the equipment and increases its ability to operate in the presence of obstacles of the type that are often encountered in excavating work and pipeline work.

When the winch attachment 46 is no longer needed, it can be detached from the backhoe 10 by removing the pin 63 and releasing the quick disconnect couplings 44. The bucket 36 can then be installed on the mounting bracket 34 and connected physically by means of the pin 63 and hydraulically by means of the couplings 44.

An alternative arrangement involves mounting the winch on the back end of the boom with the winch axle 78 in a vertical orientation. Then, the winch cable 86 can be angled to either side directly from the winch drum. This arrangement avoids the need to provide a swivel mount for the winch and is preferred in some applications.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An attachment for a backhoe machine normally having a bucket carried on the tip of a boom and controlled by fluid pressure lines, said attachment comprising:

a winch having a winch drum and a cable wound on said drum, said drum being operable by fluid pressure;

a winch bracket on which said winch drum is mounted to rotate about a winch axis to wind said cable in and out;

said winch bracket being constructed to be attached to the boom tip for pivotal movement relative thereto about a pivot axis oriented substantially perpendicular to said winch axis, thereby mounting said winch drum on the boom tip in a working position thereon; and said winch drum bracket being arranged for connection to said fluid pressure lines to receive fluid therefrom for operation of the winch drum when said winch bracket is attached to the boom tip.

2. An attachment as set forth in claim 1, wherein:

said boom includes a mounting bracket to which said bucket is detachably mounted; and said winch bracket is attachable to said mounting bracket when said bucket is detached therefrom.

3. An attachment as set forth in claim 2, wherein:

said mounting bracket includes a pair of side plates; and said winch bracket includes a pair of side plates located adjacent to said side plates of the mounting bracket when said winch bracket is attached to said mounting bracket.

4. An attachment as set forth in claim 3, wherein said winch bracket includes a plurality of rigid arms on which said winch drum is mounted, said arms being rigidly secured to said side plates of the winch bracket.

5. In combination with a backhoe normally having a bucket mounted on a tip of a boom and controlled by fluid pressure lines, the improvement comprising:

a winch having a winch bracket constructed to be mounted on the boom tip for pivotal movement relative to the boom tip about a pivot axis;

a winch drum mounted on said winch bracket for rotation about a winch axis oriented substantially perpendicular to said pivot axis, said drum being operable by fluid pressure and being constructed for connection with said fluid pressure lines; and a winch cable wound on said drum for pulling objects when said drum is rotated in a direction to wind said cable on the drum.

6. An attachment as set forth in claim 5, wherein:

said boom includes a mounting bracket to which said bucket is detachably mounted; and said winch bracket is attachable to said mounting bracket when said bucket is detached therefrom.

7. The improvement of claim 6, wherein said winch bracket includes a plurality of rigid arms and a winch frame on which said winch drum is carried for rotation about said winch axis, said arms being connected with said winch frame.

8. The improvement of claim 7, wherein said winch frame is connected with said arms in a manner allowing pivotal movement of said winch drum about said pivot axis.

9. In combination with a backhoe having a boom terminating in a boom tip, fluid pressure lines, and a rigid mounting bracket carried on the boom tip to which a detachable bucket is normally mounted and operated by said fluid pressure lines, the improvement comprising:

a winch bracket having a winch drum thereon mounted for rotation about a winch axis, said winch bracket being connected to said mounting bracket in place of said detachable bucket and being pivotal on said mounting bracket about a pivot axis oriented substantially perpendicular to said winch axis;

means for connecting said fluid pressure lines to said winch drum to control rotation thereof; and a winch cable mounted on the winch drum to pull objects when said drum is rotated in a direction to wind said cable on said drum.

10. The improvement of claim 9, wherein said winch bracket includes:

a rigid mounting portion secured to said mounting bracket;

a plurality of rigid arms extending from said mounting portion; and a winch frame carrying said winch drum thereon for rotation about said winch axis, said winch frame being connected with said arms for movement about said pivot axis.

11. The improvement of claim 9, wherein:

said mounting bracket includes a pair of side plates; and said winch bracket includes a pair of side plates located adjacent to said side plates of the mounting bracket when said winch bracket is attached to said mounting bracket.

12. The improvement of claim 11, wherein said winch bracket includes:

a plurality of rigid arms extending from said side plates of the winch bracket; and a winch frame carrying said winch drum thereon for rotation about said winch axis, said winch frame being connected with said arms for movement about said pivot axis.

* * * * *